United States Patent [19]

Walker

[11] Patent Number: 4,674,139

[45] Date of Patent: Jun. 23, 1987

[54] UNITARY WALL-MOUNTED SINK

[76] Inventor: James H. Walker, 417 Welshwood Dr., Nashville, Tenn. 37211

[21] Appl. No.: 907,600

[22] Filed: Sep. 15, 1986

Related U.S. Application Data

[62] Division of Ser. No. 494,265, May 13, 1983, Pat. No. 4,413,049.

[51] Int. Cl.[4] ..... A47K 1/05

[52] U.S. Cl. ..... 4/643; 211/88

[58] Field of Search ..... 248/235, 300; 211/88, 211/90, 126, 87, 128, 135, 134; 4/643, 648

[56] References Cited

U.S. PATENT DOCUMENTS

| | | | |
|---|---|---|---|
| 462,123 | 10/1891 | Friede | 211/88 X |
| 690,550 | 1/1902 | Barrett | 4/648 |
| 1,659,851 | 2/1928 | Brewington | 4/643 |
| 1,797,451 | 3/1931 | Statson | 211/126 X |
| 1,846,129 | 2/1932 | Gibbs | 211/90 X |
| 3,160,283 | 12/1964 | Lachance | 211/126 X |
| 3,341,026 | 9/1967 | Spitler | 211/88 |
| 4,160,570 | 7/1979 | Bridges | 211/88 X |
| 4,403,700 | 9/1983 | Manlove | 211/88 |

FOREIGN PATENT DOCUMENTS

| | | | |
|---|---|---|---|
| 1142850 | 9/1957 | France | 4/643 |
| 23142 | of 1912 | United Kingdom | 4/648 |

*Primary Examiner*—J. Franklin Foss

*Attorney, Agent, or Firm*—Pitts and Brittian

[57] ABSTRACT

A unitary sink structure for mounting to a vertical wall. The sink structure comprises a horizontal base element having a front edge and a back edge. This base element has a concave surface in at least a part to form the sink, and a drain opening is provided at the lowest point in the concave surface. Also included is a vertical attaching member or rear wall which has a front surface and a back surface, a left edge and a right edge, and a lower edge and an upper edge. The lower edge of the rear wall is permanently joined to the back edge of the base element such that the front surface of the rear wall joins the top surface of the base element. Left side member and right side member have a triangular shape with vertical edges, horizontal edges, and hypotenuse edges. These two side members have their vertical edges permanently joined to the left and right edges of the rear wall, and their horizontal edges permanently joined to the edges of the base element such that a unitary structure is provided. The hyptenuse edges of the side members are each provided with an outwardly-directed lip for strength. The device may then readily be attached to a support wall with screws or the like which pass through apertures in the rear wall into the support wall. A strengthening ridges may be included across the backwall near the fastener apertures.

12 Claims, 4 Drawing Figures

Fig. 3
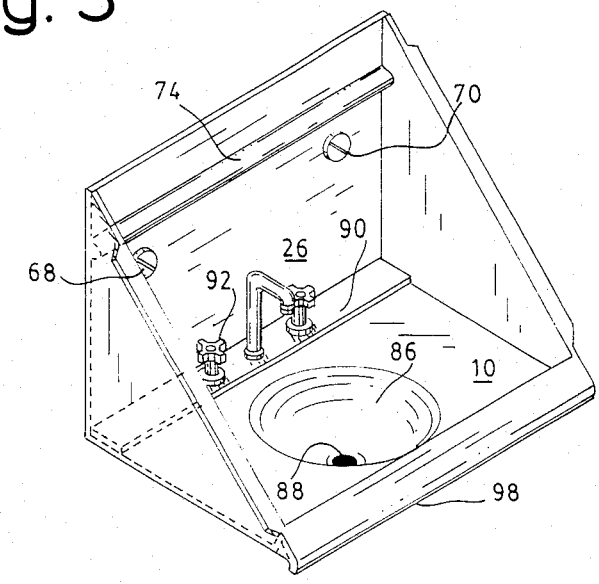
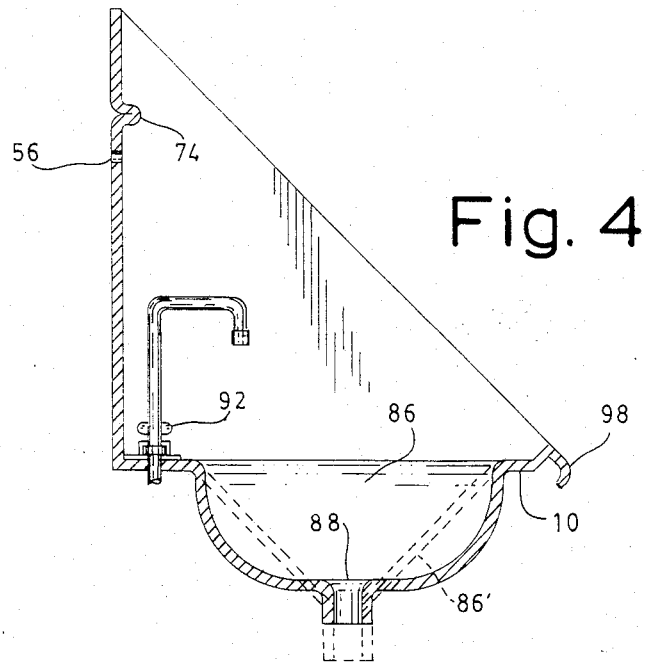
Fig. 4

UNITARY WALL-MOUNTED SINK

This application is a division of application Ser. No. 494,265 filed May 13, 1983 now U.S. Pat. No. 4,413,049.

DESCRIPTION

1. Technical Field

This invention relates generally to wall-mounted support shelves and other wall-mounted support devices, and more particularly to a molded unitary support device, suitable for use in both commercial and home applications, which is easily mounted and provides unusual strength. More particularly, the supporting device of this invention may be incorporated as simple shelving, shelving for dishwasher racks, and wall-mounted small sinks.

2. Background Art

It will be appreciated, of course, that wall-mounted shelving of many types have been available over the ages, and that it would seem that little could be left for changes in utilitarian shelving. However, certain commercial establishments such as restaurants, hotels, and the like over the years have developed specific needs and in many instances have developed products specifically suited for such institutions. As an example, commercial dishwashers used by restaurants, hotels, and the like, particularly use standard dishwasher racks for containing the large number of dishes that such a commercial establishment would use. Consequently, there has developed a need for techniques and ways of storing and more efficiently using such racks. In addition, it is often desirable to have specialized hand washing sinks available that can be easily and readily installed at almost any location on a wall without encountering expensive installation costs. To date, there simply has not been any particular shelving or support systems designed for these particular problems, although attempts have been made to service other problems in this area.

As an example, U.S. Pat. No. 3,428,187 issued to G. T. Baggott on Feb. 18, 1969 discloses a technique for supporting commercial wire dishracks, and therefore has some similarity to one of the embodiments of the present invention. However, as can be seen, the supporting rack of this invention is solely limited to supporting such dishracks and cannot serve for any other purpose. There have been, of course, other techniques described for providing shelving mounted to a vertical wall. For example, the U.S. Pat. No. 4,151,917 issued to B. J. Pugh on May 1, 1979 discloses a support piece for holding a shelf at an angle which cooperates with a specially designed bracket member which in turn locks into vertical runners. U.S. Pat. No. 4,131,203 issued to J. A. Bridges on Dec. 26, 1978 discloses a technique for supporting various types of plastic modular bins. The technique would not be suitable for supporting commercial dishracks or other purposes, since it requires a somewhat complex method of mounting the shelf to wall-mounted tracks.

Therefore, it is seen that although a strongfelt need has developed with respect to particular types of shelving and supporting systems for commercial kitchens and the like, little or no progress has been made in these areas until the present invention.

Accordingly, it is an object of the present invention to provide an inexpensive and easily manufactured wall support system which may be readily mounted to a vertical wall at substantially any location.

It is a futher object of this invention to provide a unique molded unitary supporting device which may provide support for shelves, commercial kitchen equipment, and sinks and the like.

It is still another object of this invention to provide an inexpensive, high-strength shelf system that is easily maintained and cleaned.

DISCLOSURE OF THE INVENTION

Other objects and advantages will be obvious, and will in part appear hereinafter, and will be accomplished by the present invention which provides a molded unitary supporting device for mounting to a vertical wall. The supporting device of this invention comprises a horizontal, rectangular shape support shelf, having a first edge and a second edge, which edges are substantially parallel to each other. Also included on the horizontal support shelf is a front edge and a back edge wherein the back edge has a particularly selected length, and the first edge and second edge have a second selected length. Molded to the support shelf is a vertical, rectangular shaped attaching member which has a back surface suitable for mounting in contact with the supporting wall. The lower edge of the rectangular-shaped attaching member is permanently joined or molded to the horizontal support shelf. Adjoining both the attaching member and the support shelf are a pair of substantially vertical left and right side members. Each of the side members have a right triangle shape with a short edge, a long edge, and a hypotenuse edge. The short edges of the side members are permanently molded to the left and right edges of the attaching member at substantially right angles. In addition, the long edge of both side members is permanently molded to the first and second edges of the support shelf such that the two side members, the attaching member, and the horizontal shelf comprise a single unitary molded item, having unique support strength. The system is mounted to the vertical support wall by means of attaching means such as screws which pass through the attaching member from the front surface to the back surface and at a location approximately at the upper edge of the attachment surface. The head portion of the screw prevents it from completely passing through the attaching member, and the shaft portion is then secured to the support wall. Assuming the use of two attaching screws, mounting the shelf in this manner results in only about one-third of the total weight, which may be applied to the support system, being applied to each of the attaching members as tension forces and only one-half of the total weight being applied to each of the attaching members as shear forces.

Alternate embodiments of the support device of this invention include a wall-mounted hand sink and a rack shelf, particularly designed for receiving dishwasher racks in various positions, including being stacked edgewise, being stacked vertically on top of each other, or being inclined at an angle in the rack. It may also be appreciated that the support device of this invention is preferably molded from a single piece of ABS plastic material.

BRIEF DESCRIPTION OF THE DRAWINGS

The above-mentioned features of the present invention will be more clearly understood from consideration of the following description in connection with the accompanying drawings in which:

FIG. 3 shows a perspective view of a wall-mounted unitary sink device incorporating the features of the present invention.

FIG. 4 shows a cross-sectional view along line 4—4 of FIG. 3.

BEST MODE FOR CARRYING OUT THE INVENTION

Figure 1:
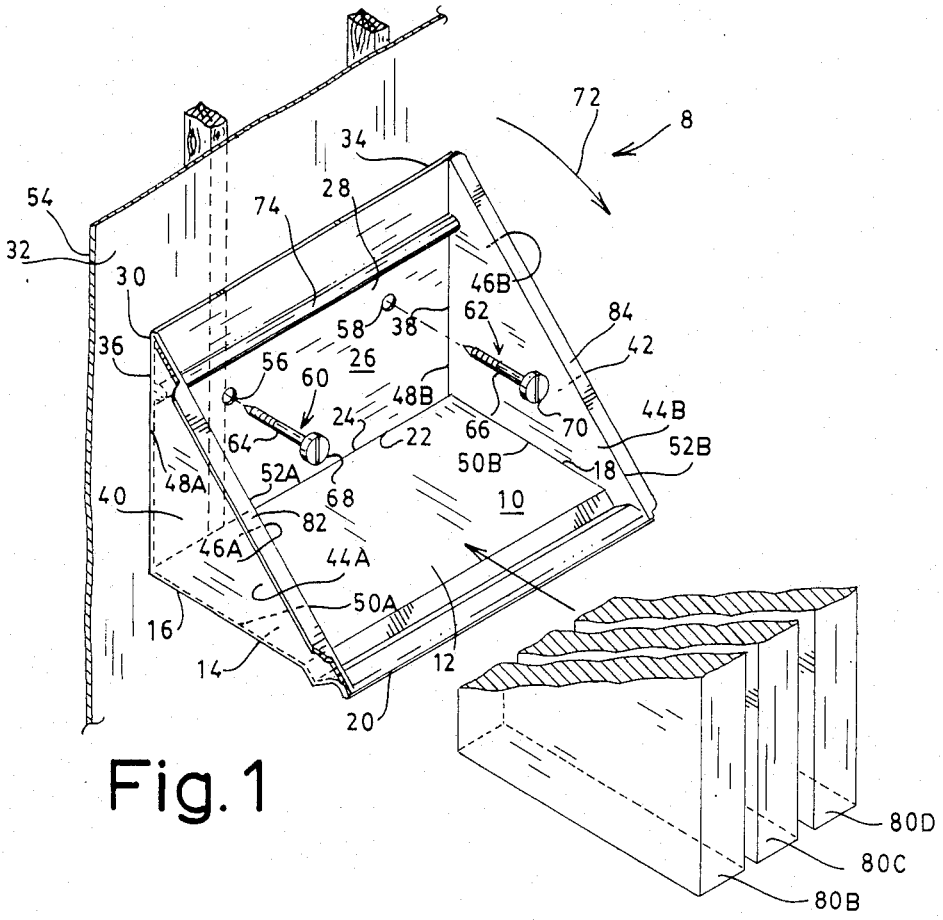
FIG. 1 shows a perspective view of one embodiment of a support device of this invention.

Referring now to FIG. 1, there is shown generally at 8 a perspective view of a support device which includes the features of this invention. As shown, there is a horizontal, rectangular shaped support shelf 10 having a top surface 12 and a bottom surface 14, which surfaces are, of course, substantially parallel to each other. Support shelf 10 further includes a first edge 16 and a second edge 18, which edges are also substantially parallel to each other. In addition, the shelf includes a front edge 20 which is substantially parallel to back edge 22. Permanently joined to back edge 22 of support shelf 10 is a lower edge 24 of a vertical, rectangular shaped attaching member 26. As shown, attaching member 26 includes a front surface 28 and a back surface 30, which back surface comes into contact with a vertical support wall 32. Also included is an upper edge 34, which upper edge is substantially parallel to lower edge 24, and a left edge 36 and a right edge 38. As can be seen, back edge 22 of support shelf 10 and lower edge 24 of attaching member 26 are permanently molded together such that front surface 28 merges with top surface 12.

Also, as can be seen, there are included a substantially vertical left side member 40 and a right side member 42. As shown, side member 40 and 42 have an inside surface 46A and 44B respectively, and an outside surface, 44A and 46B respectively. Each of the side members also defines a right triangle shape. As shown, the side members include a vertical edge 48A and 48B, a horizontal edge 50A and 50B, and a hypotenuse edge 52A and 52B. The vertical edge 48A and 48B of both the left and right side members are permanently molded to, and at a substantially right angle, with the left edge 36 and the right edge 38 respectively of the vertical, attaching member 26. In a similar manner, the horizontal edge 50A and 50B of the left and right side members are permanently molded to first edge 16 and second edge 18 respectively of the support shelf 10. Thus, it can be seen, that the inside surfaces 46A and 44B of the side members 40 and 42 are joined with the top surface 12 of the support shelf 10.

Typically, to attach the support device of this invention to a vertical wall 54, it is preferable to drill two holes or apertures 56 and 58 through attaching member 26 at a location proximate the upper edge 34. Then, to attach the support device to wall 54, it is only necessary to use attaching members such as screws 60 and 62, which include shaft portions 64 and 66, and head portions 68 and 70. It will be appreciated that the head portions 68 and 70 are larger than the diameter of the apertures 56 and 58 such that when the threads of the shaft portions 64 and 66 are attached to wall 54, the shelf will be supported. It will be appreciated, of course, that the holes 56 and 58 may be drilled at substantially any location along the top edge of attaching member 30 to assure that the attaching means 60 and 62 are received by studs or other supporting members in wall 54. Tests have shown, that significantly greater loads can be placed on a shelf supported in this manner than on shelves supported by angle braces from the underneath side. As an example, assuming the use of two attaching screws, tension forces on the attaching screws are only one-third of the total weight load on the shelf. And, of course the shear forces on the attaching screws will never be greater than one-half of the total weight load on the shelf. It will, of course, be appreciated that the screws 60 and 62 will be able to withstand significantly greater shear forces than tension forces. Further, as illustrated by arcuate angle 72, loading on the shelf 10, results in a rotational force around the attaching point of screws 60 and 62 such that a great deal of the weight is directed back into the support wall 54.

Thus, to this point, there has been described a unitary molded support structure with great flexibility for mounting to a support wall.

Although the supporting device described hereinabove results in unusual and unexpected strength and supporting qualities in a wall-mounted shelf, it has been found that a traverse ridge, such as ridge 74 molded into the attaching member 26 close to upper edge 34 provides even greater strength to the device. In particular, ridge 74 is preferably molded into member 26 just above the apertures 56 and 58 which are used for mounting the device to the support wall 54.

Figure 2:
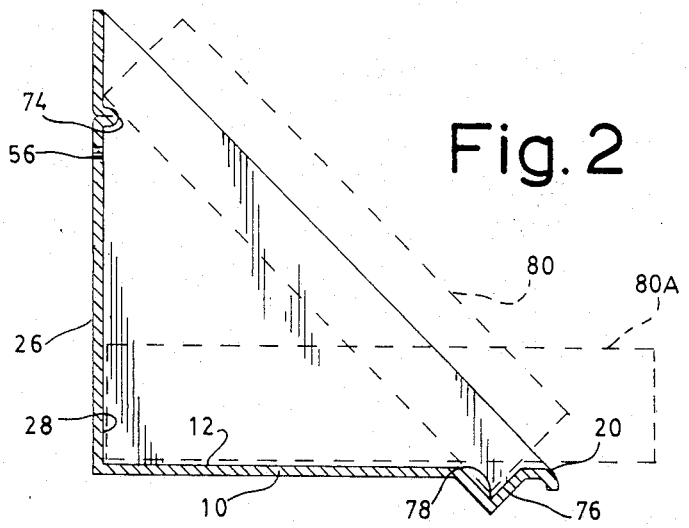
FIG. 2 shows a cross-sectional view along lines 1—1 of FIG 1.

Referring now to FIG. 2, there is shown a cross-section of the support device of FIG. 1, which shows a particular use of the device. As shown, in addition to the ridge 74 molded into attaching member 26, support shelf 10 also includes a "V" shaped trough 76 molded therein next to front edge 20. According to one preferred embodiment, the distance from the front surface 28 of attaching member 26 and the point 78 of the "V" is selected to be about 14.01 inches. At the same time, the dimension from the upper surface 12 of support member 10 to the top of the ridge 74 is about 15 inches. This particular arrangement is ideally suited for supporting a standard commercial twenty inch dishwashing rack at substantially a 45° angle as is illustrated more clearly in the side view of FIG. 2. As can be seen, the bottom edge of the dishwasher rack 80, shown in phantom lines, rests in the trough 76 and against the ridge 74. This arrangement allows easy access to the rack when it is being filled. In addition, the rack 80 can also be supported by the support device of this invention in a horizontal manner as indicated by phantom line 80A or stacked on their edge as indicated by racks 80B, 80C and 80D as shown in FIG. 1.

Although the specific dimensions discussed above are ideal with respect to supporting the standard dishwashing racks 80, the support device has many other uses as a supporting shelf. For such other use, any suitable dimensions may be used. It will also be appreciated that still further strengthening of the shelf can be achieved by the addition of edge lips 82 and 84 shown in FIG. 1 as being molded to the hypotenuse edges 52A and 52B of the side members 40 and 42.

Referring now to FIGS. 3 and 4, there is shown a perspective view and a cross-sectional view respectively of an alternate embodiment of the support device of this invention. It should be noted at this point, that those portions of the device of FIG. 2 which are similar to the portions of the devices discussed heretofore with respect to FIGS. 1 and 2, will carry the same reference numbers. As shown in FIG. 3, the support shelf 10 includes a large depression 86 molded therein which is suitable for collecting water. It will further be appreciated by those skilled in the art that the depression 86 may be either rounded, bowl-shaped or may have a more triangular or angle shape (as indicated by dashed lines at 86') for ease of molding. Also as shown, a drain or aperture 88 is molded into the lowest point of the depression 86 such that a discharge line may be attached and the device used as a sink. In the event the device is used as a sink, holes or apertures may be cut into the back portion 90 of shelf 10 such that faucet controls 92 may be added thereto. At this time it will be appreciated that by adding the water controls 92, and the drain, a convenient and easily mounted wall sink is provided. Also as shown in the embodiment of FIG. 3, there may be included a front lip 98 which will provide additional strength to the device illustrated in this figure.

It will be appreciated that although the support device of this invention may be molded from fiberglass and any other materials, it has been found that ABS plastic which is available from Monsanto Corporation, results in a particularly strong, easily cleaned and useful shelf. Of course either stainless steel or another metal could also be used. Thus, although there has been described particular embodiments of the support device of this invention, it is not intended that such specific references be considered as limitations upon the scope of this invention except insofar as are set forth in the following claims.

I claim:

1. A unitary sink structure for mounting to a vertical mounting surface with at least two fastening means passing therethrough into such mounting surface, such sink structure reducing tension and shear forces applied to such fastening means by weight applied to such sink structure, which comprises:

a substantially rectangular rear wall having a planar rear surface for being positioned against such mounting surface, said rear wall having top and bottom edges and first and second end edges, said rear wall being provided with an integral reinforcing rib parallel to and spaced from said top edge and extending proximate said end edges, and further provided with at least two apertures proximate said reinforcing rib to receive such fastening means;

a substantially rectangular base element integrally formed with said rear wall, said base element having a rear edge joined to said bottom edge of said rear wall, a front edge and first and second end edges, said front edge formed with a strengthening lip, said base element being substantially perpendicular to said rear wall and defining a concave surface intermediate said rear edge, said front edge and said first and second end edges;

first and second substantially triangular end walls integrally formed with said rear wall and said base element, each said end walls having first, second and hypotenuse edges, said first edges being coextensive with and integrally joined to said first edges and second of said rear wall, respectively, said second edges being coextensive with and integrally joined to said first and second edges, respectively, of said base element;

a reinforcing lip integrally formed along each of said hypotenuse edges of said first and second triangular end walls, said lips being oppositely directed; and whereby such unitary sink structure produced by said rear wall, said base element and said triangular end walls substantially reduces tension and shear forces applied to such fastening means when such sink structure is fastened to such mounting surface and weight is applied to said base element.

2. The sink structure of claim 1 wherein said concave surface is provided with a drain aperture.

3. The sink structure of claim 2 wherein said base element is provided with a substantially planar surface surrounding said concave surface.

4. The sink structure of claim 3 wherein said base element is provided with apertures positioned within said planar surface, and further comprises faucet controls and spout means positioned within said apertures, said spout means extending above said concave surface.

5. The sink structure of claim 4, wherein said apertures in said planar surface are positioned between said concave surface and said rear edge of said base element.

6. The sink structure of claim 3 wherein said concave surface is a substantially symmetrical bowl-shaped surface having a low point most removed from said planar surface, and said drain aperture is positioned proximate said low point.

7. The sink structure of claim 2 wherein said concave surface is a substantially cone-shaped surface having an apex, and said drain aperture is positioned proximate said apex.

8. A unitary sink structure for mounting to a vertical mounting with at least two fastening means passing therethrough into such mounting surface, such sink structure reducing tension and shear forces applied to such fastening means by weight applied to such sink structure, which comprises:

a substantially rectangular rear wall having a planar rear surface for being positioned against such mounting surface, said rear wall having top and bottom edges and first and second end edges, said rear wall being provided with an integral reinforcing rib parallel to and spaced from said top edge and extending proximate said end edges, and further provided with at least two apertures proximate said reinforcing rib to receive such fastening means;

a substantially rectangular base element integrally formed with said rear wall, said base element having a rear edge joined to said bottom edge of said rear wall, a front edge and first and second end edges, said front edge formed with a strengthening lip, said base element being substantially perpendicular to said rear wall, and defining a concave surface intermediate said rear edge, said front edge and said first and second end edges surrounded by a substantially planar surface, said concave surface having a low point most removed from said planar surface and provided with a drain aperture at said low point;

first and second substantially triangular end walls integrally formed with said rear wall and said base element, each said end walls having first, second and hypotenuse edges, said first edges being coextensive with an integrally joined to said first and second edges of said rear wall, respectively, said second edges being coextensive with and integrally joined to said first and second edges, respectively, of said base element;

a reinforcing lip integrally formed along each of said hypotenuse edges of said first and second triangular end walls, said lips being oppositely directed; and whereby such unitary sink structure produced by said rear wall, said base element and said triangular end walls substantially reduces tension and shear forces applied to such fastening means when such sink structure is fastened to such mounting surface and weight is applied to said base element.

9. The sink structure of claim 8 wherein said base element is provided with apertures positioned within said planar surface, and further comprises faucet controls and spout means positioned within said apertures, said spout means extending above said concave surface.

10. The sink structure of claim 9, wherein said apertures in said planar surface are positioned between said concave surface and said rear edge of said base element.

11. The sink structure of claim 8 wherein said concave surface is a substantially symmetrical bowl-shaped surface.

12. The sink structure of claim 8 wherein said concave surface is a substantially cone-shaped surface.

* * * * *